United States Patent [19]

Harris, deceased et al.

[11] Patent Number: 4,468,888

[45] Date of Patent: Sep. 4, 1984

[54] GATE ASSEMBLY

[75] Inventors: Frank E. Harris, deceased, late of Sheyenne, N. Dak.; by Beverly I. Lovejoy, administratix, 5040 Rimrock Rd., Billings, Mont. 59102

[73] Assignees: Beverly I. Lovejoy, Billings, Mont.; Kim M. Harris, Hermosa Beach, Calif.; Margarette C. Felchle; Ruth L. Nolan, both of Eugene, Oreg.

[21] Appl. No.: 386,874

[22] Filed: Jun. 10, 1982

Related U.S. Application Data

[63] Continuation-in-part of Ser. No. 180,571, Aug. 25, 1980.

[51] Int. Cl.[3] ..... E05F 7/06

[52] U.S. Cl. ..... 49/396

[58] Field of Search ..... 49/396

[56] References Cited

U.S. PATENT DOCUMENTS

| | | | |
|---|---|---|---|
| 548,720 | 10/1895 | McDaniel | 49/396 X |
| 1,303,486 | 5/1919 | Locke | 49/396 |
| 1,328,168 | 1/1920 | Kroon | 49/396 |
| 2,618,876 | 11/1952 | Goode | 49/396 X |

*Primary Examiner*—Kenneth Downey
*Attorney, Agent, or Firm*—Arthur L. Urban

[57] ABSTRACT

A gate assembly including a gate portion, a gate support portion and a gate connecting portion; the gate portion including vertical end braces connecting and being affixed to the ends of horizontal board members and a vertical center brace, diagonal braces extending between the lower ends of the vertical end braces and the upper end of the vertical center brace; the gate support portion including a fixed vertical support column with a generally circular cross section, a rotatable anchor collar disposed adjacent the top of the support column, the collar surrounding the upstanding support column and being spaced therefrom in a generally horizontal plane, bearings disposed between the support column and the collar, U-shaped hinges disposed around the upstanding support column and freely rotatable with respect thereto, the free ends of the hinges extending along and being affixed to opposite ends of the gate portion adjacent one end thereof; the gate connecting portion including a bracket affixed along the length of the gate portion adjacent the vertical center brace thereof, the bracket including parallel strap members with one extending downwardly at an angle along each side of the gate portion and overlapping the center brace, the lower ends of the strap members being secured to each other through one of the diagonal braces of the gate portion and pivotally connected thereto, the upper ends of the strap members extending beyond the gate portion, a hook member disposed between the upper ends of the strap members and pivotally connected thereto, a connector extending between and joining the rotatable anchor collar with the hook member, the connector including a chain section adjacent the hook member.

2 Claims, 4 Drawing Figures

GATE ASSEMBLY

This application is a continuation-in-part of pending application Ser. No. 180571, filed Aug. 25, 1980.

This invention relates to a novel gate asssembly and more particularly relates to a gate assembly in which the position of the gate portion can be changed.

For many centuries, individuals have enclosed their land to protect their home and other property. This has been done both in urban and rural areas. In some cases, the enclosures have been simple fences to keep children or animals confined, while in other situations, the fencing serves to protect the property against human or animal intruders.

Regardless of the type of enclosure or fencing utilized, some type of opening must be provided for ingress and egress to and from the property. Generally, the opening has a gate. Gates commonly are used for walkways and roadways. The most common gate style is the swinging gate. While swinging gates are satisfactory for walkways, their use becomes more cumbersome as they increase in size, such as for roadways.

Conventional roadway gates have a number of drawbacks. For example, the weight of roadway gates presents a problem of sagging. Also, the weight may make the gate difficult to operate. In an attempt to solve these problems, pairs of smaller gates meeting at the center sometimes are used.

Another problem with swinging roadway gates is clearance of the surrounding area so that the gate will have sufficient space to swing open. While provision may be made so no structure will interfere with the swing of the gate, there may be other things which interfere with the swing. For example, in cold climates, snow may accumulate to an extent that the gate cannot be opened properly. In such situations, it is necessary to shovel the excess snow away from the gate path. This operation may have to be repeated many times during a winter.

Even in climates that do not have significant snow accumulation, other things may interfere with the swing of a gate. If the gate is used for the confinement of farm animals such as cows, horses, etc., manure from the animals may accumulate near the gate. If sufficient manure accumulates, it will interfere with the swing of the gate.

Although the manure will not leave of its own accord such as melting snow does and must be removed at one time or another, interference with the swing of the gate may occur at a time when it is inconvenient to remove it. For example, this interference may occur when the weather is bad or when the landowner is wearing dress apparel. In such cases, the owner must change his clothes and begin the unpleasant task of shovelling the manure or other interfering material away from the path of the gate.

The present invention provides a novel gate assembly which allows the position of the gate to be changed. The gate assembly of the invention provides a simple and convenient means for changing the distance of a gate above a base surface. The gate operates easily with a minimum of effort irrespective of the position of the gate.

The gate assembly of the invention is simple to install and adjust by a farmer or ranch hand with a minimum of instruction. The gate assembly can be adjusted quickly in only a few minutes. The gate assembly is durable in construction and requires little if any maintenance.

The gate assembly of the invention is simple in design and can be manufactured relatively inexpensively. The gate assembly can be fabricated from commercially available materials using conventional wood or metal working techniques and semi-skilled labor. The gate assembly is suitable for mounting a variety of commercially available gates as well as specially designed custom gates.

Other benefits and advantages of the novel gate assembly of the present invention will be apparent from the following description and the accompanying drawings in which.

Figure 1:
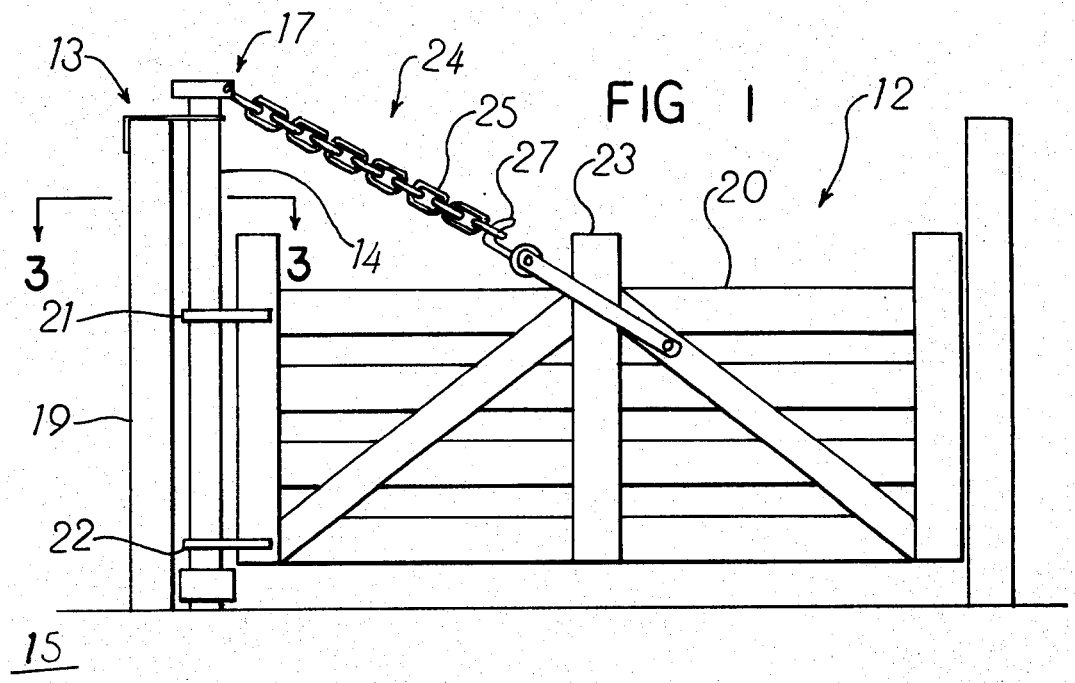
FIG. 1 is a side elevation of one form of the gate assembly of the invention.
Figure 2:
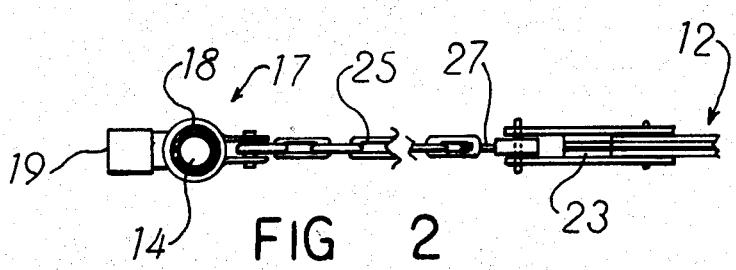
FIG. 2 is an enlarged fragmentary top view of the gate assembly shown in FIG. 1.
Figure 3:
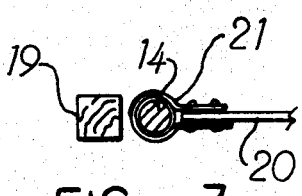
FIG. 3 is a sectional view taken along line 3—3 of FIG. 1.
Figure 4:
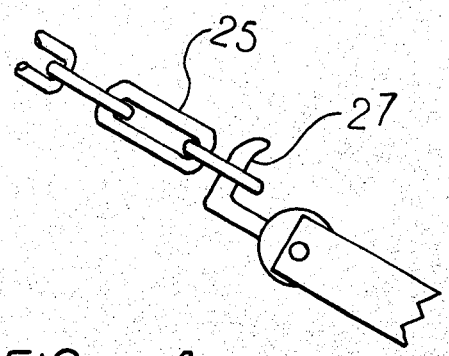
FIG. 4 is an enlarged fragmentary side view of the bracket portion of the gate assembly shown in FIG. 1.

As shown in the drawings, one form of the novel gate assembly of the present invention includes a gate portion 12, a gate support portion 13 and a gate connecting portion 24. The gate portion 12 is mounted so that the gate can be swung from a closed position to an open position and back to provide access to a fenced area.

The gate portion 12 includes a plurality of substantially horizontal board members. Vertical braces connect and are affixed to the ends of the board members. Also, the gate portion 12 includes a vertical brace connecting and being affixed to the center part of the board members. Diagonal braces extend between the lower ends of the vertical end braces and the upper end of the vertical center brace.

The gate support portion 13 includes a fixed upstanding support column 14. The support column 14 which has a generally circular cross section, has its lower end set into the ground 15 or a similar base support. The column 14 extends vertically upwardly and preferably is rigidly secured to a vertical support 19 spaced therefrom.

A rotatable anchor collar 17 is disposed adjacent the top of the support column 14 and advantageously at the top thereof. The anchor collar 17 surrounds the support column and is spaced therefrom. The collar 17 is disposed about the support column 14 in a generally horizontal plane.

Bearing means 18 are disposed between the anchor collar 17 and the support column 14. The bearings facilitate rotation of the anchor collar with respect to the support column.

U-shaped hinges 21 and 22 are disposed around the support column 14 and are freely rotatable with respect to the column. The hinges 21 and 22 are disposed with the curved part of the U surrounding the upstanding support column 14. The free ends of the hinges extend along and are affixed to opposite sides of the gate portion 12 adjacent one end thereof, that is, the end close to the upstanding column 14.

The gate connecting portion 24 of the gate assembly of the invention includes bracket means 23. The bracket 23 is disposed along the length of gate portion 12 adjacent the vertical center brace thereof. The bracket 23 includes parallel strap members. One of the strap members extends downwardly at an angle along each side of the gate portion. Each of the strap members overlaps the center brace.

The lower ends of the strap members are secured to each other through one of the diagonal braces of the gate portion. The connection of the strap members to the diagonal brace is a pivotal connection.

The upper ends of the parallel strap members extend beyond the gate portion. A hook member 27 is disposed between the upper ends of the strap members. The hook member 27 is pivotally connected to the upper ends of the strap members.

Connecting means 25 extend between and join the rotatable anchor collar 17 with the hook member 27. The connecting means 25 includes a chain section adjacent the hook member 27. Advantageously as shown, the connecting means 25 substantially completely is a chain section.

In the installation of the gate assembly of the invention as shown in the drawings, support column 14 is set into the ground with support 19 and secured thereto. Anchor collar 17 with bearings 18 is secured to the top of support column 14 and one end of chain 25 affixed thereto. Next, bracket 23 is secured in proper position on the top of the gate 12.

The gate portion 12 is placed adjacent to the upstanding support column 14 and hinges 21 and 22 are positioned so they encircle the support column. The free straight ends of the hinges then are secured to the close end of the gate. The gate 12 is raised from the ground the desired distance with the hinges 21 and 22 sliding upwardly along column 14. The free lower end of the chain 25 is connected to gate bracket 23 by attaching the chain to hook 27 on the bracket. The gate assembly is now ready for use.

The gate assembly of the invention is used in the same way as a conventional swinging gate. However, since the gate assembly is supported centrally of its length with a double pivotal connection through an anchor collar which is rotatable on bearings, it can be aligned conveniently so that it will operate easily without the sagging encountered in ordinary swinging gates. In addition, if snow or some other material should accumulate around the bottom of the gate, the spacing of the gate assembly can be increased simply by lifting the gate and fastening the chain 25 to hook 27 at a shorter length. Raising the gate assembly does not change the operation and use thereof. After the snow has melted, the gate assembly can be returned to its original position simply by lengthening the effective length of the chain 25 between the anchor collar 17 and the hook member 27.

The above description and the accompanying drawings show that the present invention provides a novel gate assembly which allows the position of the gate to be changed. The gate assembly of the invention provides a convenient means for raising or lowering the spacing of a gate above the ground. The gate can be adjusted quickly in only a few minutes.

The gate assembly of the present invention can be installed and adjusted by a farmer or ranch hand easily with a minimum of instruction. The gate assembly substantially eliminates sagging and operates easily with a minimum of effort irrespective of the height of the gate off the ground.

The gate assembly of the invention is durable in construction and requires little maintenance. The gate assembly is suitable for use with a wide variety of gates, including gates that are available commercially and also custom gates.

The gate assembly of the invention is simple in design and can be manufactured relatively inexpensively. The gate assembly can be fabricated from commercially available materials employing conventional metal and wood working techniques.

It will be apparent that various modifications can be made in the particular gate assembly described in detail and shown in the drawings within the scope of the invention. For example, the size, configuration and arrangement of components can be changed to meet specific requirements. Also, the top anchor collar can be different provided the functioning and operation of the gate assembly are not deleteriously affected. Therefore, the scope of the invention is to be limited only by the following claims.

What is claimed is:

1. A gate assembly including a gate portion, a gate support portion and a gate connecting portion; said gate portion including a plurality of substantially horizontal board members, vertical end braces connecting and being affixed to the ends of said board members, a vertical brace connecting and being affixed to the center part of said board members, diagonal braces extending between the lower ends of said vertical end braces and the upper end of said vertical center brace; said gate support portion including a fixed upstanding support column with a generally circular cross section, said support column extending vertically upwardly, a rotatable anchor collar disposed adjacent the top of said support column, said collar surrounding said upstanding support column and being spaced therefrom, said collar being disposed about said upstanding support column in a generally horizontal plane, bearing means disposed between said support column and said collar, U-shaped hinges disposed around said upstanding support column and freely rotatable with respect thereto, the free ends of said hinges extending along and being affixed to opposite sides of said gate portion adjacent one end thereof; said gate connecting portion including bracket means affixed along the length of said gate portion adjacent the vertical center brace thereof, said bracket means including parallel strap members with one extending downwardly at an angle along each side of said gate portion and overlapping said center brace, the lower ends of said strap members being secured to each other through one of said diagonal braces of said gate portion and pivotally connected thereto, the upper ends of said strap members extending beyond said gate portion, a hook member disposed between said upper ends of said strap members and pivotally connected thereto, connecting means extending between and joining said rotatable anchor collar with said hook member, said connecting means including a chain section adjacent said hook member; whereby said gate portion is pivotable about said upstanding support column and the spacing between said anchor collar and said gate portion can be changed by varying the connection of said chain section with said hook member to increase or decrease the distance between the bottom of said gate portion and a base surface from which said upstanding support column extends.

2. A gate assembly according to claim 1 wherein said upstanding support member is rigidly secured to but spaced from a vertical support.

* * * * *